US010276313B2

(12) United States Patent
Zhou et al.

(10) Patent No.: US 10,276,313 B2
(45) Date of Patent: Apr. 30, 2019

(54) HIGH-VOLTAGE EARTHING SWITCH

(71) Applicant: JIANGSHAN ELECTRICAL TECHNOLOGY DEVELOPMENT CO., LTD., Zhejiang (CN)

(72) Inventors: Lihan Zhou, Zhejiang (CN); Chunwei Jiang, Zhejiang (CN); Chaofu Mao, Zhejiang (CN)

(73) Assignee: JIANGSHAN ELECTRICAL TECHNOLOGY DEVELOPMENT CO., LTD., Zhejiang (CN)

( * ) Notice: Subject to any disclaimer, the term of this patent is extended or adjusted under 35 U.S.C. 154(b) by 0 days.

(21) Appl. No.: 15/904,445

(22) Filed: Feb. 26, 2018

(65) Prior Publication Data

US 2018/0182568 A1 Jun. 28, 2018

Related U.S. Application Data

(63) Continuation of application No. PCT/CN2016/086648, filed on Jun. 22, 2016.

(30) Foreign Application Priority Data

Aug. 26, 2015 (CN) ..... 2015 1 0530437

(51) Int. Cl.
*H01H 1/44* (2006.01)
*H01H 1/50* (2006.01)
(Continued)

(52) U.S. Cl.
CPC ..... *H01H 1/50* (2013.01); *H01H 1/38* (2013.01); *H01H 1/44* (2013.01); *H01H 1/54* (2013.01);
(Continued)

(58) Field of Classification Search
CPC .. H01H 1/44; H01H 1/42; H01H 1/50; H01H 1/06; H01H 1/38; H01H 31/003
(Continued)

(56) References Cited

U.S. PATENT DOCUMENTS 1,907,141 A * 5/1933 Bowie ..... H01H 33/022 200/15
7,091,431 B1 * 8/2006 Arcand ..... H01H 1/42 200/48 R
(Continued)

FOREIGN PATENT DOCUMENTS

CN 201352523 11/2009
CN 202650882 1/2013
(Continued)

OTHER PUBLICATIONS

"International Search Report (Form PCT/ISA/210)", dated Sep. 23, 2016, with English translation thereof, pp. 1-4.

*Primary Examiner* — Edwin A. Leon
*Assistant Examiner* — William A Bolton
(74) *Attorney, Agent, or Firm* — JCIPRNET

(57) ABSTRACT

A high-voltage earthing switch is disclosed. A static contact of the earthing switch is connected with the first end of a conductive copper busbar. The second end of the conductive copper busbar is connected with a transformer. The conductive copper busbar includes a first segment and a second segment connected with the first segment. The first segment is one straight segment and an end is taken as an end of the first end of the conductive copper busbar. The first segment extends from the static contact in the direction opposite to the instantaneous action direction of the moving contact when the moving contact engages the static contact. The second segment is connected with the other end of the first
(Continued)

segment, and extends towards the side of the first segment facing away from the moving contact.

6 Claims, 5 Drawing Sheets

(51) Int. Cl.
*H01H 1/38* (2006.01)
*H01H 1/54* (2006.01)
*H01H 31/00* (2006.01)

(52) U.S. Cl.
CPC ..... *H01H 31/003* (2013.01); *H01H 2235/00* (2013.01); *H01H 2239/044* (2013.01)

(58) Field of Classification Search
USPC ..... 218/75, 79, 80, 100; 200/15, 284; 362/23.04
See application file for complete search history.

(56) References Cited

U.S. PATENT DOCUMENTS

| | | | | |
|---|---|---|---|---|
| 2013/0328458 | A1* | 12/2013 | Crane | H01H 19/56 310/68 R |
| 2015/0092388 | A1* | 4/2015 | Beaver | F21V 33/0076 362/23.04 |
| 2015/0206667 | A1* | 7/2015 | Hussmann | H01H 1/42 200/257 |

FOREIGN PATENT DOCUMENTS

| | | |
|---|---|---|
| CN | 202977183 | 6/2013 |
| CN | 203721608 | 7/2014 |
| CN | 105185609 | 12/2015 |
| CN | 205081019 | 3/2016 |
| JP | S6193516 | 5/1986 |

* cited by examiner

HIGH-VOLTAGE EARTHING SWITCH

CROSS-REFERENCE TO RELATED APPLICATION

This application is a continuation of international PCT application serial no. PCT/CN2016/086648, filed on Jun. 22, 2016, which claims the priority benefit of China application no. 201510530437.0, filed on Aug. 26, 2015. The entirety of each of the above-mentioned patent applications is hereby incorporated by reference herein and made a part of this specification.

BACKGROUND

Technical Field of the Present Invention

The present invention belongs to the field of electrical technology and relates to an earthing switch generally used in an electrical cabinet, and more particular to a high-voltage earthing switch.

Technical Background of the Present Invention

The arrangement of a conductive copper busbar of a earthing switch in the prior art is determined according to a use occasion, the effect of an electromotive force between the conductive copper busbar and a contacting finger obtained at the moment of engaging on a switching-on action is neglected, when the electromotive force between the conductive copper busbar and the contacting finger produces a negative effect on the switching-on action, the resistance of the earthing switch to the switching-on is caused to be increased, in order that the reliability of the switching-on is ensured, the strength of a spring has to be increased, the consequence thereof not only results in an increased material cost, but also makes a moving contact, a static contact and other related components suffer from a greater impact in the switching-on, further resulting in a shortened service life of the earthing switch.

In addition, in a switching-on state, the contact area between the moving contact and the static contact is an important factor affecting the electrical performance of the earthing switch. A flat clamping structure has been provided between the moving contact and the static contact of the traditional earthing switch. For example, a static contact with a better performance in the current market comprises a base, two contacting plates opposite to each other are provided on the base, the two contacting plates are perpendicular to the upper face of the base, the outer sides of the two contacting plates are respectively provided with a supporting plate of which the lower part is relatively fixed with the base, two sets of belleville springs coaxially stacked are provided between the upper part of each supporting plate and the contacting plate at the same side. A contact surface between the contacting plate of the above static contact and a blade of the moving contact is in a shape of an oval of which two close ends are narrow and of which two remote ends are wide, or in a shape of a pillow of which two ends are wide and of which the middle is narrow. By setting two sets of the belleville springs on one side, the contact surface between the contacting plate of the static plate and the blade of the moving contact is increased. The design further effectively improves the holding capacity between the contacting plate and the blade of the moving contact, and further improves the service life of a product under the premise of ensuring the connection performance of the static contact.

However, with this design, the contact area between the static contact and the moving contact is still limited.

SUMMARY OF THE PRESENT INVENTION

The purpose of the present invention is to overcome the deficiencies of the prior art and to provide a new earthing switch, the earthing switch uses an arrangement manner of a new contact and a conductive copper busbar which may improve the mechanical and electrical performance of the switch.

An earthing switch comprises a moving contact, a contacting finger, a spring, a rack, a static contact, a conductive copper busbar and a transformer. The moving contact is fixedly connected with the contacting finger, the contacting finger is swingably connected with the rack, the spring is connected between the contacting finger and the rack. the static contact is fixedly connected with the rack via an insulator, the static contact is connected with the first end of the conductive copper busbar, the second end of the conductive copper busbar is connected with the transformer, wherein, the conductive copper busbar at least comprises a first segment and a second segment connected with the first segment, the first segment is one straight segment and an end of the first segment is taken as the first end of the conductive copper busbar, the first segment is parallel to the instantaneous action direction of the moving contact when the moving contact engages the static contact, and the first segment extends from the static contact in the direction opposite to the instantaneous action direction of the moving contact when the moving contact engages the static contact, the second segment is connected with the other end of the first segment, the second segment extends towards the side of the first segment facing away from the moving contact, the second segment is located at the side of an extended line of one end of the contacting finger connected with the moving contact when the earthing switch switching-on in the direction opposite to the instantaneous action direction at the moment when the moving contact engages the static contact.

Furthermore, the second segment comprises a straight segment, the straight segment of the second segment is perpendicular to the first segment.

Furthermore, the second segment consists of two straight segments, wherein the first straight segment is connected with the first segment, the second straight segment is connected with the first straight segment, the second straight segment is perpendicular to the first segment, an angle between the first straight segment and the first segment is an obtuse angle, an angle between the first straight segment and the second straight segment is an obtuse angle.

Based on the above structural design of the conductive copper busbar, the electromotive force between the conductive copper busbar and the contacting finger may positively affect the connection between the moving contact and the static contact at the moment when the moving contact of the earthing switch is connected with the static contact thereof.

Furthermore, the contacting finger consists of a front end portion fixing the moving contact and a swing atm connecting the front end portion and the rack, a ladder is formed between the front end portion of the contacting finger and the second straight segment of the second segment of the conductive copper busbar, two diagonals of the ladder are d1 and d2 respectively, two waists thereof are s1 and s2 respectively, the height thereof is a, preferably, the proportion of d1:d2:s1:s2:a is 1:2.2:1.22:1.61:1, the front end portion of the contacting finger and the first segment of the conductive copper busbar (excluding the portion contacted with the static contact, and the remaining portion is an effective portion) constitute two conductors perpendicular to each other, the length of the front end portion of the contacting finger is set as a, the length of the effective portion of the first segment of the conductive copper busbar is set as h, the widths of the front end portion of the contacting finger and the first segment of the conductive copper busbar are both 2*r*, preferably, the proportion of a:h:r is 7.53:6.08:1.

Furthermore, the moving contact is a circular moving contact, the static contact comprises a body and a plurality of contacting finger strips provided in a circular hole on the body, the contacting finger strip is arranged in a circular array along the side wall of the circular hole. a leaf spring is provided between the contacting finger strip and the side wall of the circular hole, preferably, a total of 16 and above contacting finger strips are provided. A plurality of the contacting fingers is in a ring-shaped arrangement, being capable of effectively increasing a contact area, reducing a contact resistance, and preventing the contact from welding.

Furthermore, the static contact is fixed to the insulator through an L-shaped right-angle connector. One surface of the body of the static contact which is provided with a circular hole is set as the top surface, the other surface opposite to the top surface is the bottom surface of the body, and the remaining surfaces are the side surfaces of the body. One side of the side surface of the body of the static contact is a plane, the first end of the conductive copper busbar is fixedly connected to the plane, the side thereof opposite to the plane is an arc surface, the arc surface has a smooth transition with each the other two sides of the side surfaces of the body of the static contact. One right-angle edge of the L-shaped right-angle connector is fixedly connected with the end surface of the insulator, the other right-angle edge of the L-shaped right-angle connector is fixedly connected with the bottom surface of the body of the static contact. The structure of the body of the above static contact may achieve the technical effects that the switch is reliably switched on and off and the assembly thereof is convenient, under the premise of ensuring that the technical solution proposed by the present invention for making an electromotive force play a positive effect may be realized.

Furthermore, a gap of 2.5 mm to 5.5 mm is provided between the neighboring contacting finger strips of the static contact, since the gap is provided, when current flows by, a holding effect based on the electromotive force may be formed, increasing a contact pressure between the contacting finger strip and the moving contact.

Figure 1:
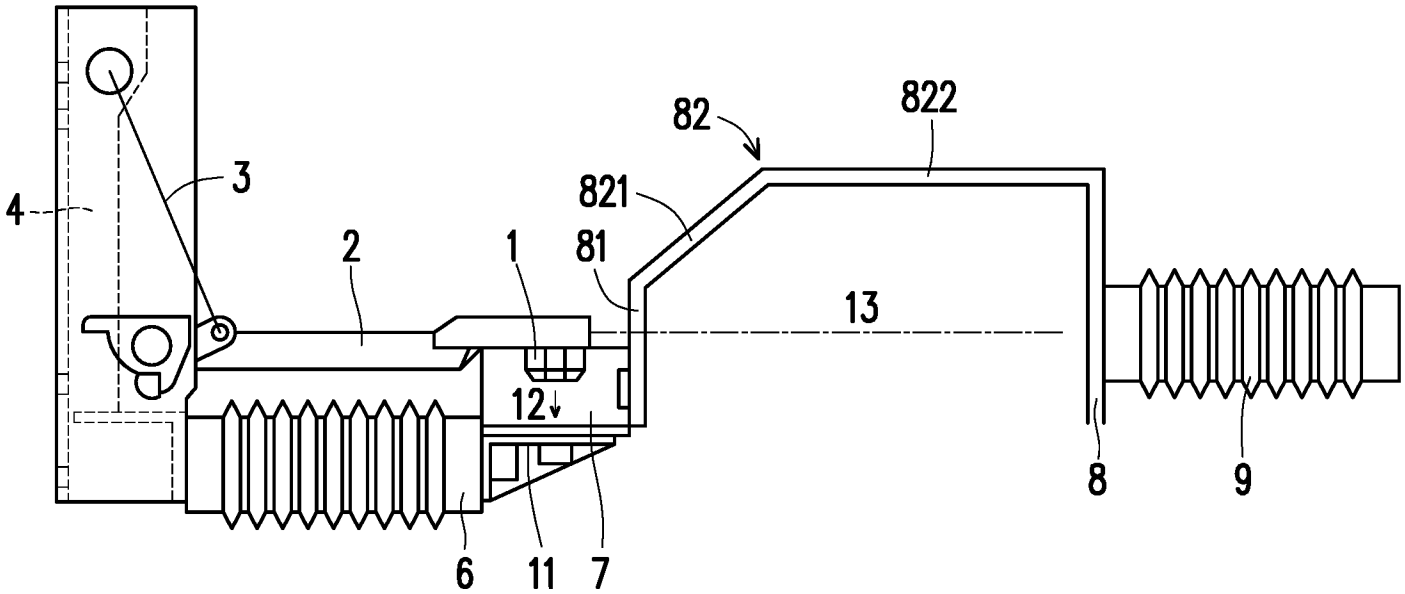
FIG. 1 is a diagram of an overall structure of a earthing switch of the present invention.
Figure 2:
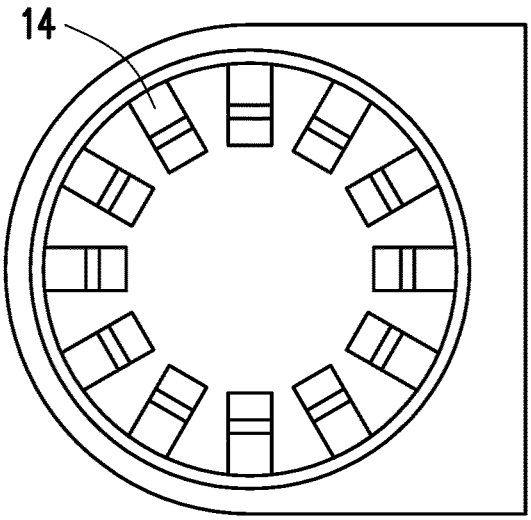
FIG. 2 is a top view of a static contact.
Figure 3:
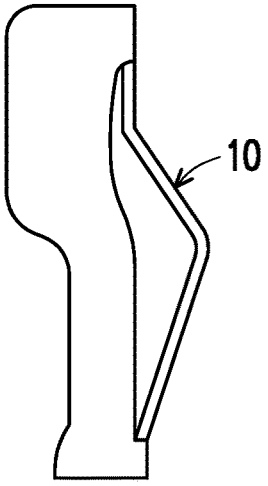
FIG. 3 is a structural diagram of a single contacting finger of a static contact and a reed of an earthing switch.
Figure 4:
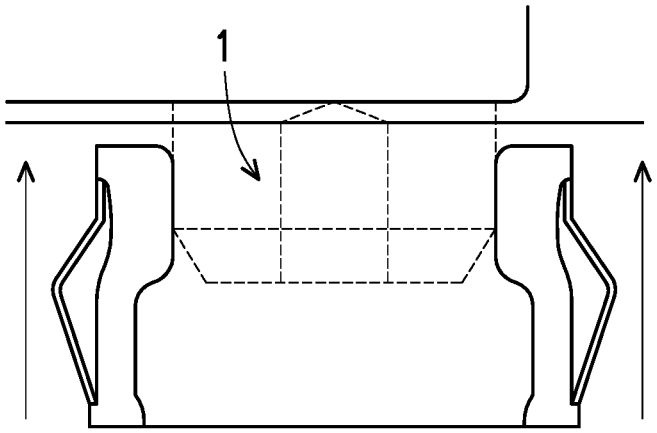
FIG. 4 is a diagram of an engagement state of a moving contact and a contacting finger strip.

In the FIGS.: Moving Contact 1, Contacting Finger 2, Spring 3, Rack 4, Insulator 6, Static Contact 7, Conductive Copper Busbar 8, Transformer 9, Leaf spring 10, L-shaped right-angle connector 11, First segment of the conductive copper busbar 81, Second segment of the conductive copper busbar 82, First straight segment of the second segment of the conductive copper busbar 821, Second straight segment of the second segment of the conductive copper busbar 822, instantaneous action direction of the moving contact when the moving contact engages the static contact 12, extended line of one end of the contacting finger connected with the moving contact when the earthing switch switching-on 13, Contacting finger strip 14.

DETAILED DESCRIPTION OF PREFERRED EMBODIMENTS

As shown in FIGS. 1-4, an earthing switch of the invention comprises a moving contact 1, a contacting finger 2, a spring 3, a rack 4, an insulator 6, a static contact 7, a conductive copper busbar 8, and a transformer 9. The moving contact 1 is fixedly connected with the contacting finger 2. The contacting finger 2 is connected with the rack 4. The spring 3 is connected between the contacting finger 2 and the rack 4. One end of the insulator 6 is fixed with the rack 4. The static contact 7 is fixed on the other end of the insulator 6 via an L-shaped right-angle connector 11. The first end of the conductive copper busbar 8 is fixed with the static contact 7, and a second end of the conductive copper busbar 8 is connected with the transformer 9.

In the following description, as shown in FIG. 1, the instantaneous action direction 12 of the moving contact when the moving contact engages the static contact is downward, otherwise, being upward, the direction indicated by one end of the contacting finger connected with the moving contact in the engaged state is taken as the right, otherwise, as the left.

The conductive copper busbar comprises a first segment 81 with an end taking as the first end of the conductive copper busbar and a second segment connected with the first segment 81, the first segment 81 is parallel to the instantaneous action direction 12 of the moving contact when the moving contact engages the static contact, the first segment 81 extends upward from the static contact 7; the second segment extends toward right side from the upper end of the first segment 81, the second segment is located above an extended line 13 of the contacting finger toward the right side in the switching-on state. the second segment consists of two straight segments, wherein the left end of the first straight segment 821 is connected with the upper end of the first segment 81, the second straight segment 822 is connected with the right end of the first straight segment 821, the second straight segment 822 is perpendicular to the first segment 81, the angle between the first straight segment 821 and the first segment 81 is an obtuse angle, the angle between the first straight segment 821 and the second straight segment 822 is also an obtuse angle.

A circular hole is provided on the body of the static contact 7, 16 contacting finger strips 14 are arranged in a circular array along the side wall of the circular hole in the circular hole, a gap of 2.5 mm to 5.5 mm is provided between the respective contacting finger strips 14 of the static contact. A leaf spring 10 is provided between the contacting finger strip 14 and the side wall of the circular hole.

The right side surface of the body of the static contact is one plane, and the first end of the conductive copper busbar 8 is fixedly connected to the plane. The left side surface of the body of the static contact 7 is an arc surface, and the arc surface has a smooth transition with front and back side surfaces of the body of the static contact 7. The vertical edge of the L-shaped right-angle connector 11 is fixed with the end surface of the insulator 6 via a bolt, and the horizontal edge of the L-shaped right-angle connector 11 is fixed with the bottom surface of the body of the static contact 7 via the bolt.

The contacting finger 2 consists of a front end portion fixing the moving contact and a swing arm connecting the front end portion and the rack 4.

Figure 5:
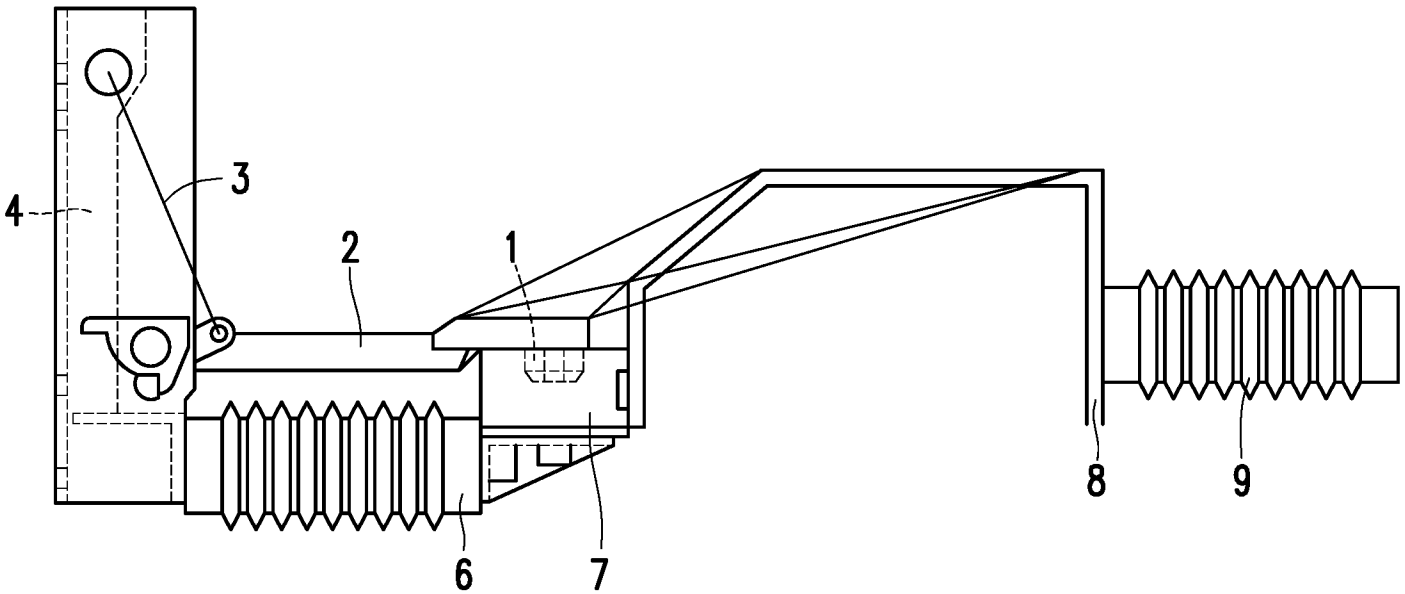
FIG. 5 is an analysis diagram of an electromotive force of an earthing switch.
Figure 6:
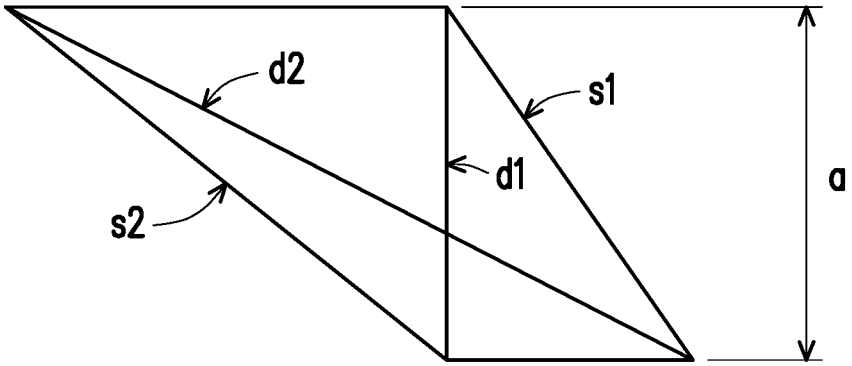
FIG. 6 is an analysis diagram of an electromotive force between a front end portion of a contacting finger and a second straight segment of a second segment of a conductive copper busbar.
Figure 7:
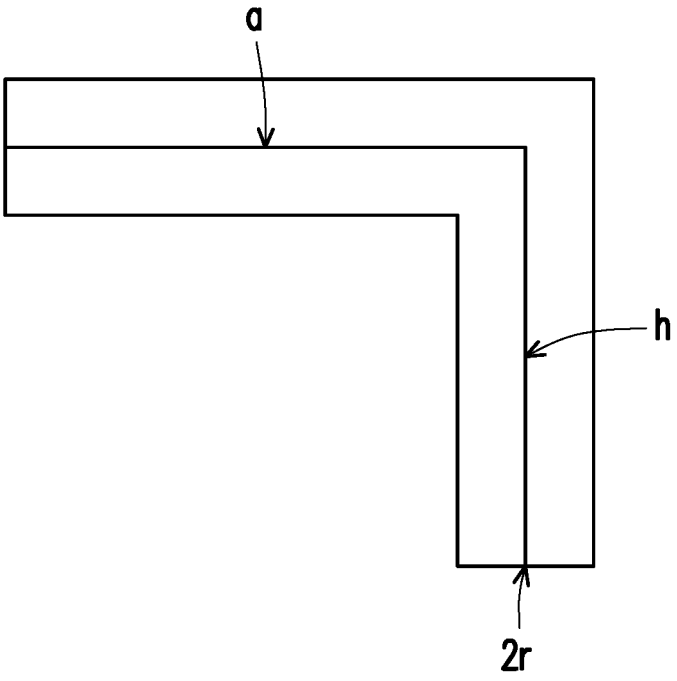
FIG. 7 is an analysis diagram of an electromotive force between a front end portion of a contacting finger and a first segment of a conductive copper busbar.

As shown in FIGS. 5-7, a ladder is formed between the front end portion of the contacting finger and the second straight segment of the second segment of the conductive copper busbar. Two diagonals of the ladder are d1 and d2, respectively. Two waists thereof are s1 and s2, respectively. The height thereof is a. Preferably, the proportion of d1:d2:s1:s2:a is 1:2.2:1.22:1.61:1. The front end portion of the contacting finger and the first segment of the conductive copper busbar (excluding the portion contacted with the static contact, and the remaining portion is an effective portion) constitute two conductors perpendicular to each other. The length of the front end portion of the contacting finger is set as a. The length of the effective portion of the first segment of the conductive copper busbar is set as h. The widths of the front end portion of the contacting finger and the first segment of the conductive copper busbar are both 2*r*. Preferably, the proportion of a:h:r is 7.53:6.08:1.

An electromotive force loop coefficient between the front end portion of the contacting finger and the second straight segment of the second segment of the conductive copper busbar is formulated as:

$$c = \frac{(d_1 + d_2) - (s_2 + s_1)}{a}.$$

An electromotive force loop coefficient between the front end portion of the contacting finger and the first segment of the conductive copper busbar is formulated as:

$$c = \ln\left[\frac{2ah}{r\left(h + \sqrt{h^2 + a^2}\right)}\right].$$

Therefore, distance between two wires a is increased would effectively reduce the coefficient of the electromotive force c, and thus being able to reduce the interference of the electromotive force on the earthing switch.

The process of an action of the earthing switch is provided as follows. When it is needed to switch on, an operational mechanism drives the contacting finger to be rotated clockwise. When the contacting finger is rotated by a critical point of the spring, the contacting finger is rotated rapidly until the contacting finger is rotated clockwise by 90°, then the moving contact is inserted into the contacting finger strip of the earthing static contact, and the moving contact engages the static contact to realize the earthing. When it is needed to switch off, the operational mechanism drives the contacting finger to be rotated counterclockwise. The moving contact disengages from the static contact. When the contacting finger is rotated by a critical point of the spring, the contacting finger is rotated rapidly until the contacting finger is rotated counterclockwise by 90°, then the contacting finger keeps a set position under a limit position.

What is claimed is:

1. A high-voltage earthing switch, comprising a moving contact, a contacting finger, a rack, an insulator, a static contact, a conductive copper busbar, and a transformer; wherein the moving contact is fixedly connected with the contacting finger, the contacting finger is swingably connected with the rack, the static contact is fixedly connected with the rack via the insulator, the static contact is connected with a first end of the conductive copper busbar, a second end of the conductive copper busbar is connected with the transformer, the conductive copper busbar comprises a first segment and a second segment connected with the first segment, the first segment is one straight segment, an end of the first segment is the first end of the conductive copper busbar, the first segment is parallel to an instantaneous action direction of the moving contact when the moving contact engages the static contact, the first segment extends from the static contact in a direction opposite to the instantaneous action direction of the moving contact when the moving contact engages the static contact, the second segment is connected with the other end of the first segment, the second segment extends towards a side of the first segment, which faces away from the moving contact, and the second segment is located at one side of an extended line of one end of the contacting finger connected with the moving contact when the earthing switch switching-on in the direction opposite to the instantaneous action direction of the moving contact when the moving contact engages the static contact.

2. The high-voltage earthing switch according to claim 1, wherein the second segment comprises a straight segment, and the straight segment of the second segment is perpendicular to the first segment.

3. The high-voltage earthing switch according to claim 1, wherein the second segment consists a first straight segment and a second straight segment, the first straight segment is connected with the first segment, the second straight segment is connected with the first straight segment, the second straight segment is perpendicular to the first segment, an angle between the first straight segment and the first segment is an obtuse angle, and an angle between the first straight segment and the second straight segment is an obtuse angle.

4. The high-voltage earthing switch according to claim 1, wherein the moving contact is a circular moving contact, the static contact comprises a body and a plurality of contacting finger strips provided in a circular hole on the body, the plurality of contacting finger strips are arranged in a circular array along a side wall of the circular hole, and a leaf spring is provided between a contacting finger strip of the plurality of contacting finger strips and the side wall of the circular hole.

5. The high-voltage earthing switch according to claim 4, wherein the static contact is fixed to the insulator through an L-shaped right-angle connector, the body of the static contact comprises four side surfaces, one of the four side surfaces of the body of the static contact is a plane, the first end of the conductive copper busbar is fixedly connected to the plane, another side surface of the four side surfaces opposite to the plane is an arc surface, the arc surface has a smooth transition with each of the other two of the four side surfaces of the body of the static contact, one right-angle edge of the L-shaped right-angle connector is fixedly connected with an end surface of the insulator, the other right-angle edge of the L-shaped right-angle connector is fixedly connected with a bottom surface of the body of the static contact.

6. The high-voltage earthing switch according to claim 5, wherein a gap of 2.5 mm to 5.5 mm is provided between neighboring contacting finger strips of the plurality of the contacting finger strips of the static contact.

* * * * *